United States Patent [19]

Umeda et al.

[11] Patent Number: 4,835,135

[45] Date of Patent: May 30, 1989

[54] COLOR-DEVELOPING SHEET FOR PRESSURE-SENSITIVE RECORDING SHEETS

[75] Inventors: Hiroaki Umeda; Mamoru Suzuki; Akira Hasegawa; Kunio Hata, all of Tokyo, Japan

[73] Assignee: Jujo Paper Co., Ltd., Tokyo, Japan

[21] Appl. No.: 134,684

[22] Filed: Dec. 18, 1987

[30] Foreign Application Priority Data

Jan. 16, 1987 [JP] Japan ..... 62-7528

[51] Int. Cl.[4] ..... B41M 5/16

[52] U.S. Cl. ..... 503/210; 427/150; 428/342; 428/914; 503/211; 503/212; 503/217; 503/225

[58] Field of Search ..... 427/150–152; 428/914, 341, 342; 503/210–212, 216, 217, 219, 225

[56] References Cited

U.S. PATENT DOCUMENTS 4,749,680 6/1988 Umeda et al. ..... 503/210

FOREIGN PATENT DOCUMENTS 60-159540 7/1985 Japan ..... 503/212

*Primary Examiner*—Bruce H. Hess

*Attorney, Agent, or Firm*—Koda and Androlia

[57] ABSTRACT

The color-developing sheet for pressure-sensitive recording sheet contains a color-developing agent comprising an inorganic solid acid in combination with a polyvalent metal salt of carboxylated terpenephenol resin and/or a reaction product of carboxylated terpenephenol resin, aromatic carboxylic acid and polyvalent metal compound.

This color-developing sheet is superior in both sunlight fading resistance and water resistance.

8 Claims, No Drawings

COLOR-DEVELOPING SHEET FOR PRESSURE-SENSITIVE RECORDING SHEETS

BACKGROUND OF THE INVENTION

1. Field of the Invention

This invention relates to a color-developing sheet for pressure-sensitive recording sheets using as a color-developing agent an inorganic solid acid, characterized in that the color-developing sheet has an improved preservability.

2. Prior Art

Pressure-sensitive recording sheets are known as carbonless copying paper. They produce a color upon the application of a mechanical or impact pressure by writing or by pounding a typewriter, thus permitting duplication of several copies. A colored image is formed by a color-developing reaction of a electron-donating colorless dyestuff and a electron-accepting color-developing agent.

Hitherto, many kinds of electron-accepting color-developing agents are well-known. The typical color-developing agents include inorganic solid acids such as acid clay, activated clay, attapulgite (described in U.S. Pat. No. 2,712,507); substituted phenols and diphenols (described in the Japanese Patent Publication No. 9309/1985); p-substituted phenol-formaldehyde polymers (described in the Japanese Patent Publication No. 20144/1967); aromatic carboxylic acid metal salts (described in the Japanese Patent Publication Nos. 10856/1974 and 1327/1977); 2,2'-bisphenol sulfone compounds (described in the Japanese Patent Laid-Open No. 106313/1979); and so on.

An inorganic solid acid adsorbes the above electron-donating colorless dyestuff and is reacted with it to form a colored image. As an inorganic solid acid, there are included acid clay as montmorillonite type clay; activates clay which is prepared by treating an acid clay with a mineral acid; attapulgite which is a magnesium-aluminum-silicate mineral; and the like.

These inorganic solid acids have been widely applied for practical use as color-developing agent for pressure-sensitive recording sheet, since they provide a higher color-developing rate, a superior image density and a clear color tone owing to a superior adsorption ability. However, they have the defects that a colored image fades easily under exposure of ultraviolet ray, etc., a black-developed image discolor gradually to reddish black, a colored image disappears for some time in presence of water, and the like. In order to overcome these defects, there have been proposed an improved process for producing an inorganic solid acid and its use in combination with a polyvalent metal salt, an aromatic carboxylic acid, or the like. However, these proposed methods provide yet no sufficient results. As described above, a color-developing sheet containing an inorganic solid acid has defects that sunlight fading-resistance and water-resistance are inferior.

SUMMARY OF THE INVENTION

It is an object of this invention to provide a color-developing sheet containing an inorganic solid acid as a color-developing agent which is superior in both sunlight fading-resistance and water-resistance of a colored image.

DETAILED DESCRIPTION OF THE INVENTION

The above object may be performed by using a color-developing agent comprising an inorganic solid acid in combination with at least one member selected from the group consisting of a polyvalent metal salt of carboxylated terpenephenol resin and a reaction product of carboxylated terpenephenol resin, aromatic carboxylic acid and polyvalent metal compound. In this case, sunlight fading-resistance and water-resistance of a colored image are remarkably improved under maintaining a fast color-developing rate and a high image density as advantages of color-developing sheet containing anorganic solid acid.

The improved water-resistance led to a decrease of disappearance of a colored image.

Inorganic solid acids of this invention include, for example, acid clay, attapulgite, zeolite, bentonite, kaolin, silicic acid, synthetic silicic acid, aluminum silicate, zinc silicate, etc., and chemically or physically treated product thereof.

The polyvalent metal salt of carboxylated terpenephenol resin and a reaction product of carboxylated terpenephenol resin, aromatic carboxylic acid and polyvalent metal salt of this invention are color-developing agents having a novel structure proposed by the inventors, and they are color-developing agents which are superior in yellowing-resistance and plasticizer-resistance.

As described in the Japanese Patent Application No. 159540/1985, the carboxylated terpenphenol resin is prepared by the following process.

The addition reaction of cyclic monoterpene and phenol is carried out in petroleum-solvent in the presence of an acidic catalyst, e.g. aluminum chloride, boron trifluoride, sulfuric acid, polyphosphoric acid, to prepare a condensation product. Cyclic monoterpene used in this invention includes, for example, pinene, limonene, terpinolene, methadiene, gum-turpentine oil which contains α-pinen as main ingredient, dipentene which contains α-limonene as main ingredient, and the like.

Phenol used in this invention includes monophenols, for example, carbolic acid, alkyl-substituted phenols, alkoxy-substituted phenols, halogenated phenols, etc.; and polyvalent phenols, for example, resorcin, catechol, etc.

Petroleum solvent used in this invention includes, for example, benzene, toluene, xylene, n-hexan, n-heptane, halogenized solvent such as dichloromethane, chloroform, trichloroethane, brombenzene, etc. The condensation product is made basic with alkaline metal, alkaline metal hydroxide, or alkaline metal carbonate. The basic condensation product is allowed to react with carbonic acid gas under high temperature (140°–180° C.) and high pressure (5–30 atm.) in an autoclave to introduce carboxy groups. (Kolbe-Schmitt's reaction).

After the completion of reaction, the solvent is removed by a distillation. Meanwhile, the product is cooled to room temperature and washed to separate out the unreactants. The resultant product is extracted with an aqueous alkaline solution. After the neutralization of extracted product, carboxylated terpenephenol resin is separated out. After filtrating and washing, a purified carboxylated terpenephenol resin is obtained.

A polyvalent metal salt of carboxylated terpenephenol resin are prepared by a method which comprises melting the carboxylated terpenephenol resin together with oxide, hydroxide, chloride, carbonate or sulfate of polyvalent metal and inorganic ammonium salt and thereby making them to react, or by a method which comprises dissolving carboxylated terpenephenol resin together with hydroxide of alkali metal in a solvent such as water, alcohol, etc., adding alcohol-soluble polyvalent metal salts thereto and thereby carring out the reaction, or by other methods.

Polyvalent metal used in this invention includes, for example, magnesium, aluminium, calcium, cadmium, titanium, zinc, nickel, cobalt, magnanese etc.

Magnesium, aluminium and zinc are preferable, and zinc is most preferable.

As previously is proposed, the reaction product of carboxylated terpenephenol resin, aromatic carboxylic acid and polyvalent metal compound is prepared either by mixing the carboxylated terpenephenol resin, the aromatic carboxylic acid and polyvalent metal compound uniformly and then causing the reaction thereof, or by mixing above two ingredients uniformly, adding the third ingredient to the mixture and causing a reaction thereof. Uniform mixing is performed by dissolving the ingredients in a solvent under stirring or by melting them under heating, and the like.

Examples for the solvent include aqueous basic solutions such as sodium hydroxide, potassium hydroxide, sodium carbonate, etc.; organic solvents such as alcohol, aceton, etc.; and the mixture thereof.

Aromatic carboxylic acid, in which carboxyl group is bonded to an aromatic ring (mono-ring or polyrings), includes, for example, benzoic acid, p-hydroxybenzoic acid, chlorobenzoic acid, bromobenzoic acid, nitrobenzoic acid, methoxybenzoic acid, ethoxybenzoic acid, toluic acid; ethylbenzoic acid, p-n-propylbenzoic acid, p-isopropylbenzoic acid, 3-methyl-4-hydroxybenzoic acid, 3-ethyl-4-hydroxybenzoic acid, 3-methoxy-4-hydroxybenzoic acid, p-tert.-butylbenzoic acid, o-benzoylbenzoic acid, p-cyclohexylbenzoic acid, salicylic acid, 3-methyl-5-tert.-butylsalicylic acid, 3,5-ditert.-butylsalicylic acid, 5-nonylsalicylic acid, 5-cyclohexylsalicylic acid, 3-cyclohexylsalicylic acid, 3,5-diamylsalicylic acid, cresotic acid, 5-nonylsalicylic acid, 5-cumylsalicylic acid, 3-phenylsalicylic acid, 3,5-sec.-butylsalicylic acid, 2,4-dihydroxybenzoic acid, 2,5-dihydroxybenzoic acid, gallic acid, naphthoic acid, phthalic acid monobenzyl ester, phthalic acid monocyclohexyl ester, salicylosalicylic acid, 3-tert.-butyl-5-α-methylbenzylsalicylic acid, 3,5- di(α-methylbenzyl) salicylic acid, phthalic acid, terephthalic acid, isophthalic acid, diphenic acid, naphthalene dicarboxylic acid, naphtholic acid, and the like.

Among these carboxylic acids, mono-carboxylic acids are most preferable.

Polyvalent metal compound used in this invention includes, for example, oxides, halides, carbonates, sulfates, nitrates, acetates, formates, oxalates, benzoates, acetylacetonates, salicylates, etc. of magnesium, aluminum, cadmium, calcium, titanium, zinc, nickel, cobalt, manganese, vanadium and the like. Magnesium compounds, aluminium compounds and zinc compounds are preferable; and zinc compounds is most preferable.

The polyvalent metal salt of acarboxylated terpenephenol resin and/or the reaction product of carboxylated terpenephenol resin, aromatic carboxylic acid and polyvalent metal compound, based on the amount of inorganic solid acid is not otherwise limited. However, in ordinary case, it is suitable to at least 1 weight-% preferably at least 30 weight-% inorganic solid acid.

Each of the inorganic solid acid, the polyvalent metal salt of carboxylated terpenephenol resin, and the reaction product of carboxylated terpenephenol resin, aromatic carboxylic acid and polyvalent metal compound is dispersed in water or organic solvent for use.

A coating solution for the color-developing agents is prepared as follows:

(1) Color-developing agents are dispersed with a dispersing agent individually, mixed together, and filler, binder, etc. are added to the mixed color-developing agents, (2) Color-developing agents are dispersed simultaneously, and filler, binder, etc. are added to the dispersed color-developing agent, or (3) Color-developing agents are mixed, dissolved by heating or in solvent, are dispersed with a dispersing agent, and filler, binder, etc. are added to the dispersed color-developing agents.

A color-developing sheet is prepared by coating the above coating solution as a single layer on a substrate uniformly. However, there may be used multi-layer coating method which comprises applying on a substrate a coating solution containing a color-developing agent, superposing thereon a coating solution containing another color-developing agent and the like.

The color-developing agent of this invention is applied to a wide range of field concerning pressure-sensitive recording sheets, for example, a middle sheet of pressure-sensitive recording sheets, a bottom sheet thereof, a single-type pressure-sensitive recording sheet by coating as laminated layer or as a mixed-state layer; a detecting agent of leuco dyestuff by dissolving this salt in organic solvent; a spot printing ink by mixing this salt with wax, etc.; a pressure-sensitive color-developing ink by encapsulating of color-developing and/or leuco dyestuff; and the like.

The color-developing sheet which contains the color-developing agent of this invention is prepared by the conventionally known method, for example:

(a) applying on a support such as paper, an aqueous coating color in which an aqueous suspension of a color-developing agent is used;

(b) adding the color-developing agent to the stuff in a paper making; and (c) coating on the surface of the support the organic splvent in which a color-developing agent is dissolved or suspended, and then drying the coated support.

The coating color is produced by mixing kaolin-clays, calcium carbonate, starch, polyvinyl alcohol and synthetic or natural latex, and then giving appropriate viscosity and coating suitability for the mixed materials. It is desirable to use 10 to 70% by weight of the color-developing agent, based on the total solid content in the coating color. If the color-developing agent is less than 10% by weight, the sufficient results cannot be attained. If the color-developing agent is more than 70%, the surface properties of the color-developing sheet is inferior.

The coating weight is more than 0.5 g/m$^2$, preferably 1.0–10 g/m$^2$. The color-developing agent of this invention can be used for the conventionally known pressure-sensitive color-forming dye. Examples of these dyes are as follows.

Triphenylmethane leuco dyes

Crystal violet lactone, malachite green lactone, 3-dimethylamino-triphenylmethanephthalide, and the like.

Fluoran leuco dyes 3,6-dimethoxyfluoran, 3-N-cyclohexylamino-6-chlorofluoran, 3-diethylamino-6-methyl-7-chlorofluoran, 1,2-benzo-6-dimethylaminofluoran, 1,2-benzo-(2',diethylamino)-6-diethylaminofluoran, 3-diethylamino-7-dibenzylaminofluoran, 3-diethylamino-6-methyl-7-dibenzylaminofluoran, 3-diethylamino-5-methyl-7-dibenzylaminofluoran, 3-diethylamino-7-aminofluorane,3-diethylamino-6-methyl-7-anilinofluoran, 3-diethylamino-7-(o-acetyl)anilinofluoran, 3-diethylamino-7-piperidinofluoran, 3-diethylamino-7-pyrolidinofluoran, and the like.

Spiroyran leuco dyes spiro-[3-methylchromene-2,2'-7'-diethylamino chromene], spiro[3-methylchormene-2,2'-7'-dibenzylamino-chromene], 6',8'-dichloro-1-3,3-trimethyl-indolino-benzospiropyan, 1,3,3-trimethyl-6'-nitrospiro (indoline)-2,2'-2'H chromene, spiro[1,3,3-trimethylindoline-2, 3'-8'-bromonaphtho-[2,1-b]pyran], spiro[3-methyl-benzo(5,6-a)chromene-2,2'-7'-diethylaminochromene and the like.

Phenothiazine leuco dyes 3-diethylamino-7(N-methylanilino)-10-benzoyl-phenoxazine; 3,7-bis(dimethylamino)-10-benzoylphenothiazine, 10-(3',4',5'-trimethoxy-benzoyl)-3,7-bis-(dimethylamino)-phenothiazine, and the like.

Phthalide leuco dyes 3-4(diethylamino-2-ethoxyphenyl)-3-(1-ethyl-2-methylindol-3-yl) 7-azaphthalide, and the like.

Indol leuco dyes 3,3 bis(1-octyl-2-methylindol-3-yl)phthalide, and the like.

Triphenylmethane leuco dyes

N-butyl-3[bis- 4-N-methylanilino)phenyl methyl]carbazole and the like.

This invention improves an sunlight fading-resistance and a water-resistance which are the defects of color-developing sheet containing an inorganic solid acid as color-developing agent. The reason therefor is probably that the polyvalent metal salt of carboxylated terpene-phenol resin or the reaction product of carboxylated terpenephenol resin, aromatic carboxylic acid and polyvalent metal compound has an improved sunlight fading resistance and a superior water resistance.

EXAMPLES

The following examples are given merely as illustrative of this invention and are not to be considered as limiting. All percentages and parts throughout the application are by weight unless otherwise indicated.

The transfer sheet coated with pressure-sensitive dye-containing microcapsules and the evaluation of the color-developing sheet under using this transfer sheet are as follows.

Preparation of a transfer sheet 90 parts of a 10% aqueous solution of an ethylene-maleic anhydride copolymer (trade mark: EMA-31, made by Monsanto Co.) and 90 parts of dilution water were mixed, and 10 parts of urea and 1 part of resorcinol were dissolved in the mixed solution. The obtained solution was adjusted to a pH-value of 3.4.

Separately, an oil mixture consisting of alkyldiphenylethane (trade mark: Hysol SAS 296, made by Nisseki chemical Co.) and diisopropylnaphthalene (trade mark: KMC-113, made by Kureha Chemical Co.) in a proportion of 1:1 was prepared.

As two core materials, (a) the oil of blue color-forming dye was prepared by dissolving 3% of crystal violet lactone (CVL) and 1% of benzoyl leuco methylene blue in the above oil mixture, and (b) the oil of black color-forming dye was prepared by dissolving 5% of 3-diethylamino-6-methyl-7-anilinofluoran, 1% of 3-diethylamino-6-methyl-7-diphenylmethylaminofluoran and 0.5% of 3-diethylamino-6-methyl-7-chlorofluoran in the above oil mixture.

180 parts of each of above dye oils were added to the above-produced aqueous solution of a pH-value having 3.4, and emulsified until an average particle size of 4.0 was obtained.

To this emulsion were added 27 parts of 37% formalin and heated to 55° C. After carrying out at encapsulation reaction at 55° C. for 2 hours, the reacted solution was adjusted to a pH-value of 7.5 by the addition of 28% aqueous ammonia solution to prepare two capsule slurries which contains pressure-sensitive dyes.

180 parts of each of the capsule slurries, 40 parts of wheat starch and 85 parts of 8% oxidized starch solution were mixed to prepare two kinds of coating solution.

These coating solutions were independently coated on a fine paper having a basis weight of 45 g/m$^2$ to obtain (a) blue color-forming transfer sheet and (b) black color-forming transfer sheet.

Evaluation of the color-developing sheet

Each of the transfer sheets (a) and (b) and a color-developing sheet are laid so that the coated surfaces of the sheets are faced with each other.

The obtained colored sheets were tested with regard to color-developing rate, end color-developing intensity and light fastness. The test results are summarized in Table 1.

(1) Color-developing rate and color-developing intensity

A CB-sheet coated with microcapsules and a color-developing sheet coated with a color-developing agent are laid so that the two coated surfaces are faced with each other. A pressure is applied to the two sheet by dot-plate roll calender to form a color. The reflectance $I_0$ of the sheet before color development, the reflectance $I_1$ of the sheet of 10 sec after color development, are measured by a Hunter Reflectmeter (manufactured by Toyo Seiki Co.; D type) using an amber filter. The color-developing rate ($J_1$) is expressed by the following equation:

$$\text{Color-developing rate } J_1 = \frac{I_0 - I_1}{I_0} \times 100\ (\%)$$

-continued

And color-developing intensity is expressed by the following equation, using the reflectance $I_2$ of the sheet of 24 hours after color development.

$$\text{Color-developing intensity } J_2 = \frac{I_0 - I_2}{I_0} \times 100\ (\%)$$

Higher values of $J_1$ and $J_2$ are preferred.

(2) Sunlight fading resistance

The surface 24 hours after the color-development by the method described in (1) is exposed to sunlight for 8 hours. The reflectance of the blue-developed image (A) is measured by using a Hunter Reflectmeter. Using the reflectance $I_3$ of the sheet 8 hours after color development, the image density ($J_3$) is calculated in accordance with the following equation, $$J_3 = \frac{I_0 - I_3}{I_0} \times 100\ (\%)$$

The sunlight fading resistance of the blue-developed image (H) is expressed by the following equation.

$$H = (J_3/J_2) \times 100\ (\%)$$

Higher values show less fading the sheet under sunlight.

With regard to a black developed-image, a color ton is evaluated with unaided eyes.

(3) Water resistance

The color-developing sheet 24 hours after color development by the method described in (1) is dipped in water for 3 hours. Thereafter, the disappearance degree of the image in the presence of water is evaluated with unaided eyes.

EXAMPLE 1

Preparation of water suspension of inorganic solid acid.

100 parts of activated clay (Trade name: shilton DR-1; manufactured by Mizusawa Chemical Co.) were gradually added to 100 parts of water in which 1 part of sodium pyrophosphate as a dispersant has been dissolved, under stirring with an agitator. In this manner, water suspension No. 1 was obtained in dispersed state.

Preparation of water suspension of carboxylated terpenephenol resin zinc-salt 100 parts of carboxylated terpenephenol resin zinc-salt (manufactured from α-pinene and carbolic acid) were added to 147.5 parts of water containing 2.5 parts of sodium polyacrylate and emulsified by a sand grinder. In this manner, water suspension No. 2 having an average size of 3 μ was obtained.

Preparation of the color developing sheet

Water suspension No. 1:100 parts
Water suspension No. 2:30 parts
Styrene-butadiene latex (40%): 20 parts
Oxidized starch: 10 parts A composition of the above formulation was prepared and adjusted to a pH-value of 8.5 by adding sodium hydroxide solution. The coating composition having a concentration of 30% (solid) was prepared by adding water, and coated with Meyer bar on a fine paper of 50 g/m² so that the applied amount was 6.0 g/m² (solid).

EXAMPLE 2

A color-developing sheet was prepared in the same manner as in Example 1 except that a reaction product of zinc chloride, 3,5-ditert.-butylsalicylic acid and carboxylated terpenephenol resin (manufactured from limonene and carbolic acid) instead of carboxylated terpenephenol resin zinc-salt in Example 1 was used.

EXAMPLE 3

A color-developing sheet was prepared in the same manner as in Example 1 except that carboxylated terpenephenol resin zinc-salt (manufactured from gumturpentine oil and 0-cresol) was used instead of carboxylated terpenephenol resin zinc-salt (manufactured from α-pinene and carbolic acid).

COMPARATIVE EXAMPLE 1

Using water suspension No. 1, a color-developing sheet was prepared as follows.

Water suspension No. 1:100 parts
Styrene-butadiene latex: 18 parts
Oxidized starch: 6 parts .

The above compositions were admixed and then adjusted to a pH-value of 9.0 by adding hydroxide solution. Next, water was added thereto to obtain a coating color having a solid concentration of 30%. In the same manner as in Example 1, a color-developing sheet was prepared. As seen clearly in Table 1, the color-developing sheet of this invention provides a remarkably improved sunlight fading resistance and a superior water resistance, compared with the color-developing sheet containing an inorganic solid acid alone.

TABLE 1

| | | Properties | | | |
|---|---|---|---|---|---|
| | Kinds of transfer sheet | Color-developing rate $J_1$ | Color-developing intensity $J_2$ | Sunlight fading resistance H, evaluation by unaided eye | Water resistancy |
| Example 1 | A | 44.8 | 50.0 | 60.4 | Excellent |
| | B | 45.0 | 51.6 | Reddish black | — |
| Example 2 | A | 43.9 | 49.7 | 59.7 | Excellent |
| | B | 44.4 | 48.2 | Reddish black | — |
| Example 3 | A | 43.5 | 48.3 | 58.1 | Common |
| | B | 44.2 | 48.0 | Reddish black | — |
| Comparative example 1 | A | 42.0 | 45.7 | 45.8 | Inferior |
| | B | 44.5 | 48.2 | Red brown | — |

EFFECTS OF THIS INVENTION

As described above, this invention provides a practically useful color-developing sheet which are superior in both sunlight fading resistance and water resistance under maintaining both a fast color-developing rate and a high image density as advantages of a color-developing sheet containing an inorganic solid acid.

We claim:

1. A color-developing sheet for pressure-sensitive recording sheets comprising an inorganic solid acid as a color-developing agent and an electron-donating colorless dyestuff as a color-forming agent, said color-developing sheet having on a substrate at least a color-developing layer comprising as a color-developing agent an inorganic solid acid in combination with at least one substance selected from the group consisting of a polyvalent metal salt of carboxylated terpene-phenol resin and a reaction product of carboxylated terpenephenol resin, aromatic carboxylic acid and polyvalent metal compound.

2. The color-developing sheet according to claim 1, wherein said polyvalent metal is zinc.

3. The color-developing sheet according to claim 1, wherein said substance is at least 1% by weight, based on said inorganic solid acid.

4. The color-developing sheet according to claim 3, wherein said substance is at least 30% by weight, based on said inorganic solid acid.

5. The color-developing sheet according to claim 1, wherein said color-developing agent is contained in a range of 10–70% by weight, based on the total solid content in said color-developing layer.

6. The color-developing sheet according to claim 1, wherein the weight of said color-developing layer is 1.0–10.0 $g/m^2$.

7. The color-developing sheet according to claim 1, wherein said color-developing agent is used in combination with at least one dye selected from the group consisting of triphenylmethane leuco dyes, fluoran leuco dyes, spiropyran leuco dyes, phenothiazine leuco dyes, phthalide leuco dyes and indol leuco dyes.

8. The color-developing sheet according to claim 1, wherein said aromatic carboxylic acid is aromatic monocarboxylic acid.

* * * * *